US008479390B2

(12) United States Patent
Ohnishi et al.

(10) Patent No.: US 8,479,390 B2
(45) Date of Patent: Jul. 9, 2013

(54) METHOD FOR PRODUCING CONNECTOR

(75) Inventors: Teruyuki Ohnishi, Atsugi (JP); Shinichi Isobe, Ebina (JP); Kohtaro Shiino, Isehara (JP)

(73) Assignee: Hitachi Automotive Systems, Ltd., Hitachinaka-shi (JP)

( * ) Notice: Subject to any disclaimer, the term of this patent is extended or adjusted under 35 U.S.C. 154(b) by 129 days.

(21) Appl. No.: 12/958,888

(22) Filed: Dec. 2, 2010

(65) Prior Publication Data

US 2011/0151692 A1 Jun. 23, 2011

(30) Foreign Application Priority Data

Dec. 21, 2009 (JP) ..... 2009-288920

(51) Int. Cl.
*H01R 12/70* (2011.01)
*H01R 43/00* (2006.01)

(52) U.S. Cl.
USPC ..... 29/878; 29/874; 29/876; 29/883; 29/884; 29/885; 427/123; 228/180.1; 228/254; 228/259; 439/83; 205/122; 205/128; 205/129

(58) Field of Classification Search
USPC ..... 29/874, 876, 883, 884, 885, 843, 29/878; 427/123, 117; 174/260–262, 267; 228/180.1–180.22, 254, 256–262; 439/83; 205/122, 128, 129, 102, 105, 109, 118, 125, 205/157
See application file for complete search history.

(56) References Cited

U.S. PATENT DOCUMENTS

| | | | | |
|---|---|---|---|---|
| 2,649,619 | A * | 8/1953 | Killian | 425/272 |
| 2,756,485 | A * | 7/1956 | Abramson et al. | 29/830 |
| 3,068,566 | A * | 12/1962 | Berg | 29/527.4 |
| 3,144,572 | A * | 8/1964 | Smader | 310/71 |
| 3,284,605 | A * | 11/1966 | Anderson et al. | 200/275 |
| 3,665,367 | A * | 5/1972 | Keller et al. | 439/866 |
| 3,754,324 | A * | 8/1973 | Krehbiel et al. | 29/853 |
| 3,834,015 | A * | 9/1974 | Di Renzo | 29/843 |
| 3,849,870 | A * | 11/1974 | Cobaugh et al. | 228/173.1 |
| 3,915,546 | A * | 10/1975 | Cobaugh et al. | 439/876 |
| 3,977,075 | A * | 8/1976 | Lynch et al. | 29/830 |
| 3,989,331 | A * | 11/1976 | Hanlon | 439/70 |
| 4,027,279 | A * | 5/1977 | Shigehara | 336/90 |
| 4,087,906 | A * | 5/1978 | Cobaugh et al. | 29/885 |
| 4,385,791 | A * | 5/1983 | Lovrenich | 439/83 |
| 4,390,221 | A * | 6/1983 | Niles et al. | 439/83 |

(Continued)

FOREIGN PATENT DOCUMENTS

JP 08-122175 A 5/1996

*Primary Examiner* — Peter DungBa Vo
*Assistant Examiner* — Kaying Kue
(74) *Attorney, Agent, or Firm* — Foley & Lardner LLP

(57) ABSTRACT

A method for producing a connector has first to fifth processes. In the first process, a contact unit having a plurality of contacts and a tying part, is formed with the contacts tied at each axial direction middle part of the contacts by the tying part and with the contacts arranged parallel to each other. In the second process, a plating layer is formed on a part of the contact unit by soaking the contact unit in a plating bath from an axial direction one end side of the contact unit to an axial direction middle part of the tying part. In the third process, the contacts are isolated by cutting the tying part. In the fourth process, a part where the plating layer is formed, of the contact is inserted into a hole of a circuit board. In the fifth process, the contacts are soldered to the circuit board.

17 Claims, 8 Drawing Sheets

U.S. PATENT DOCUMENTS 4,427,520 A * 1/1984 Bahnsen et al. ..... 204/224 R
4,499,120 A * 2/1985 Marshall, Jr. ..... 427/123
4,574,297 A * 3/1986 Ooi ..... 257/696
4,655,881 A * 4/1987 Tezuka et al. ..... 205/104
4,767,344 A * 8/1988 Noschese ..... 439/83
5,957,736 A * 9/1999 Moriuchi et al. ..... 439/876
6,379,161 B1 * 4/2002 Ma ..... 439/83
6,739,044 B2 * 5/2004 Abouchar ..... 29/837
6,777,319 B2 * 8/2004 Grube et al. ..... 438/612
7,047,638 B2 * 5/2006 Eldridge et al. ..... 29/884
7,080,451 B2 * 7/2006 Saito et al. ..... 29/874
7,271,602 B2 * 9/2007 Tunaboylu et al. ..... 324/756.03
7,377,795 B2 * 5/2008 Vicich et al. ..... 439/83
7,459,923 B2 * 12/2008 Caldwell et al. ..... 324/754.18
8,179,692 B2 * 5/2012 Ihara ..... 361/787
2001/0004556 A1 * 6/2001 Zhou et al. ..... 439/66
2003/0113990 A1 * 6/2003 Grube et al. ..... 438/612

* cited by examiner

METHOD FOR PRODUCING CONNECTOR

BACKGROUND OF THE INVENTION

The present invention relates to a connector and a method for producing the connector.

Regarding a connector in a related art technique, a contact unit made of conductive material is soaked in a plating bath, and a plating layer is coated on the contact unit. This plating layer is soldered to a circuit board for connecting and fixing the connector to the circuit board. An example relating to such technique has been disclosed in Japanese Patent Provisional Publication No. 8-122175 (hereinafter is referred to as "3P8-122175").

SUMMARY OF THE INVENTION

In the related art connector, however, it is required that a fillet shape of solder should be formed more uniformly for each contact of the contact unit.

To meet this requirement, an object of the present invention is to provide a connector and a method for producing the connector, which is capable of uniformly forming the fillet shape of the solder for each contact of the contact unit.

According to one aspect of the present invention, a method for producing a connector comprises: a first process that forms a contact unit, the contact unit having a plurality of rod-shaped contacts made of conductive material and a tying part, the plurality of contacts being tied at each axial direction middle part of the contacts by the tying part with the contacts arranged substantially parallel to each other, and a width surface of the contact which continuously unites with the other surfaces of the contacts through the tying part and a width surface of the tying part being substantially flat; a second process that forms a plating layer on a part of the contact unit by soaking the contact unit in a plating bath storing plating agents that have higher wettability than that of the contact unit from an axial direction one end side of the contact unit up to an axial direction middle part of the tying part; a third process that isolates the plurality of contacts by cutting the tying part; a fourth process that inserts a part where the plating layer is formed, of the each contact into a hole of an electronic circuit board; and a fifth process that solders the contacts to the electronic circuit board.

According to another aspect of the present invention, a method for producing a connector comprises: a first process that forms a contact unit, the contact unit having a plurality of rod-shaped contacts made of conductive material and a tying part, the plurality of contacts being tied at each axial direction middle part of the contacts by the tying part with the contacts arranged substantially parallel to each other, and a width surface of the contact which continuously unites with the other surfaces of the contacts through the tying part and a width surface of the tying part being substantially flat; a second process that forms a plating layer on a part of the contact unit by soaking the contact unit in a plating bath storing plating agents that have higher wettability than that of the contact unit from an axial direction one end side of the contact unit up to a portion positioned on the axial direction one end side with respect to an axial direction middle part of the tying part also at least an area where the tying part is coated with the plating agents; a third process that isolates the plurality of contacts by cutting the tying part; a fourth process that inserts a part where the plating layer is formed, of the each contact into a hole of an electronic circuit board; and a fifth process that solders the contacts to the electronic circuit board.

According to a further aspect of the invention, a connector structure comprises: a rod-shaped contact unit made of conductive material, an axial direction one end side of which is connected by soldering; a protrusion part which is provided at an axial direction middle part of the contact unit and is formed so as to protrude outwards in a radial direction; a plating layer which is provided from the axial direction one end side of the contact unit up to an axial direction one end side edge portion of the protrusion part and is coated with plating agents having higher wettability than that of the contact unit; an electronic circuit board which has a hole for inserting therein the contact unit from the axial direction one end side of the contact unit up to an axial direction middle part of the plating layer; and solder which is provided so as to cover the plating layer of the contact unit and the hole of the electronic circuit board and fixes and electrically connects the contact unit to the electronic circuit board.

The other objects and features of this invention will become understood from the following description with reference to the accompanying drawings.

DETAILED DESCRIPTION OF THE INVENTION

Embodiments of the present invention will be explained below with reference to the drawings. Embodiments explained below have been considered so as to meet many of the needs, and one of the needs is to be able to uniformly form the fillet shape of the solder for each contact of the contact unit. Embodiments can also facilitate the production of the contact unit.

[Embodiment 1]

First, configuration will be explained.

[Torque Sensor]

Figure 1:
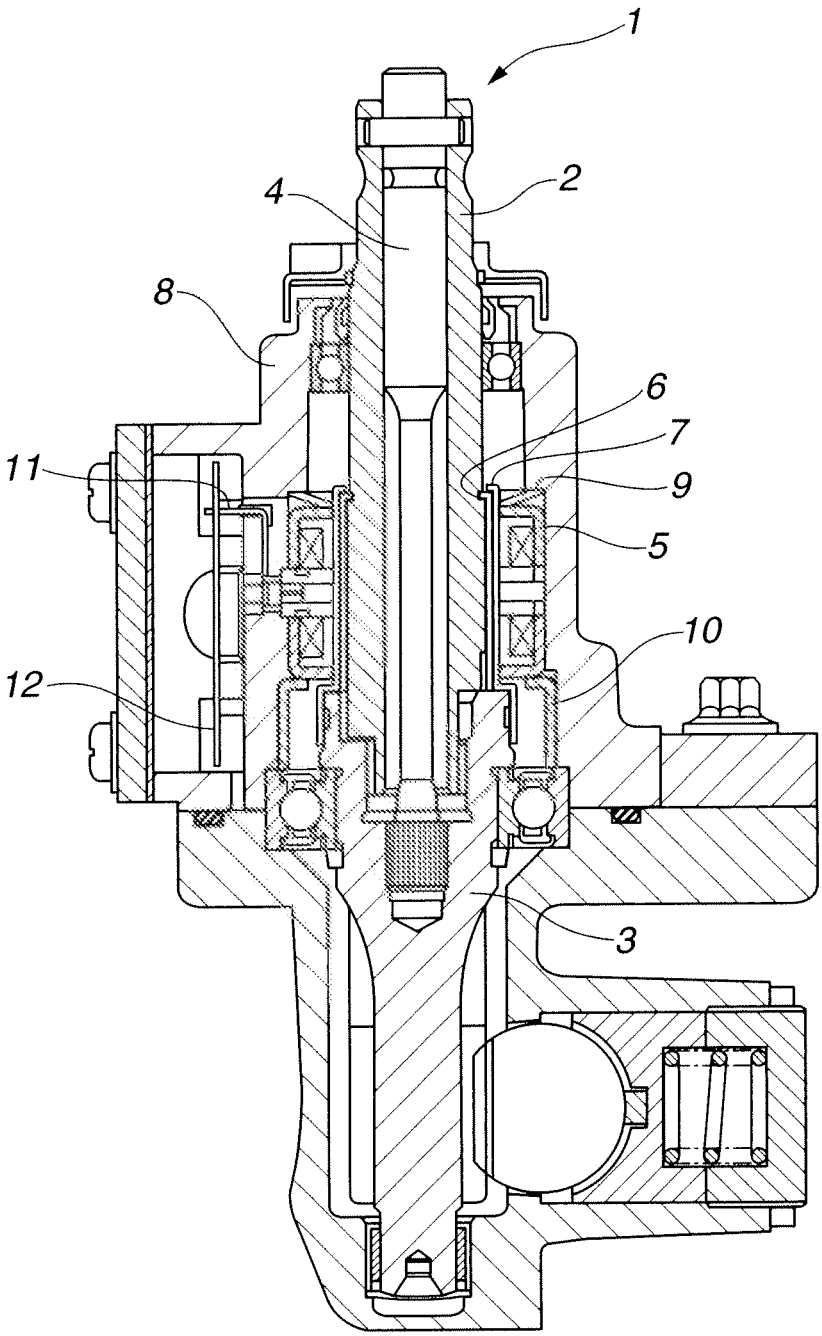
FIG. 1 is a sectional view of a torque sensor 1 of an embodiment 1.

FIG. 1 is a sectional view of a torque sensor 1 of an embodiment 1. The torque sensor 1 is set on a steering shaft between a steering wheel and a rack-and-pinion in a steering system of a vehicle.

An input shaft 2 connected to the steering wheel and an output shaft 3 connected to the pinion gear are connected to each other through a torsion bar 4 having a specified quantity of rigidity in a rotation direction. An inner ring 6, which is non-magnetic material and conductive material and has a plurality of window parts (not shown) in a circumferential direction, is fixed on the input shaft 2 by swaging or crimping etc. An outer ring 7, which is non-magnetic material and conductive material and has a plurality of window parts (not shown) in a circumferential direction, is fixed to the output shaft 3 by swaging or crimping etc.

A coil assembly 5 is set inside a housing 8 with the coil assembly 5 supported in an axial direction by an elastic member 9 and a fixing member 10.

When torque is inputted to the input shaft 2 and the input shaft 2 rotates by driver's steering operation, the output shaft 3 is rotated through the torsion bar 4, and a relative angle between the input shaft 2 and the output shaft 3 changes by an angle of twist or screw of the torsion bar 4. At this time, a relative angle between the inner ring 6 and the outer ring 7, fixed to the input shaft 2 and the output shaft 3 respectively, also changes, and a relationship of positions of the window parts provided in the inner ring 6 and the outer ring 7 changes. This change of the window position relationship brings about a change in magnetic reluctance of magnetic flux which the coil assembly 5 produces. Thus, as an impedance change, detection of a torque amount becomes possible through the coil assembly 5.

Figure 2:
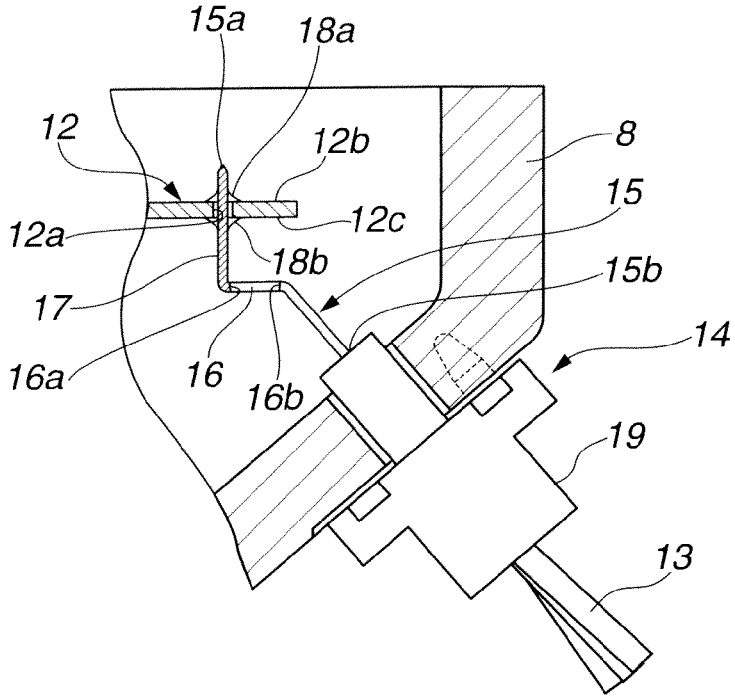
FIG. 2 is a drawing showing a connector 14 of the embodiment 1.

A value of the detected impedance is inputted from a coil terminal 11 to an electronic circuit board (hereinafter, circuit board) 12 that is attached to the housing 8 with a screw. The impedance value is converted to a value of voltage in the circuit board 12, then is outputted to an external circuit or device outside the housing 8 through a harness 13, as shown in FIG. 2. FIG. 2 is a drawing showing a connector 14 of the embodiment 1. The connector 14 has the circuit board 12, a plurality of harness connection (or hookup) pin terminals 15 (each of which is a contact, hereinafter called a connection pin terminal 15), a protrusion part 16, a plating layer 17, and fillets (solder) 18*a* and 18*b*, for each connection pin terminal 15.

The connection pin terminal 15 is made of conductive material and has a bar or rod shape. The plurality of connection pin terminals 15 are arranged almost parallel to each other at a certain interval, and each axial direction one end side (each axial direction top end side) 15*a* of the connection pin terminal 15 is soldered to the circuit board 12. The plurality of axial direction other end sides (axial direction base end sides) 15*b* of the connection pin terminals 15 are molded in a resin mold 19, then each of the axial direction other end sides 15*b* is secured to the resin mold 19.

The resin mold 19 is fixed to an outside of the housing 8 with a screw etc. The harness 13 and the plurality of connection pin terminals 15 are connected to each other in the resin mold 19.

Figure 8:
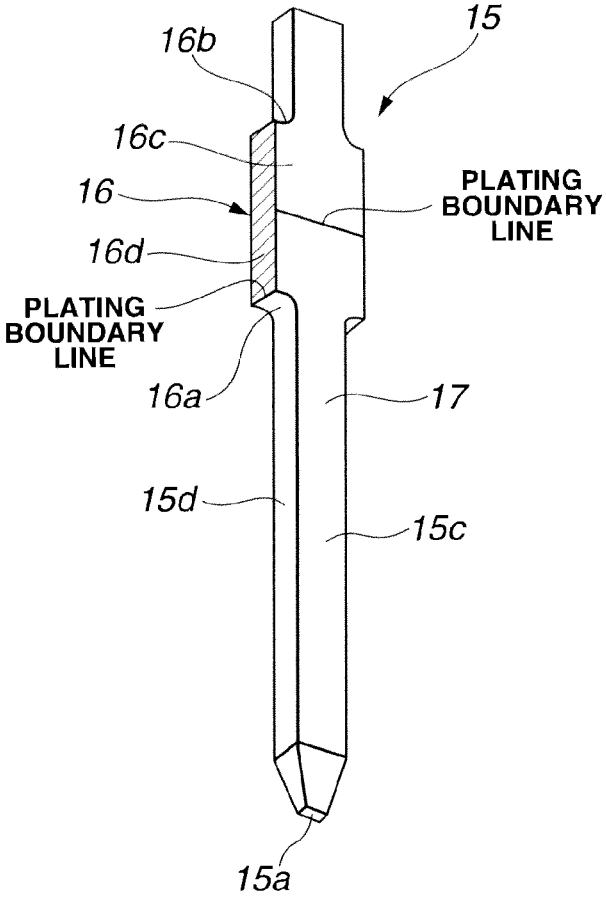
FIG. 8 is a perspective view of the connection pin terminal 15 after the third process of the embodiment 1.

The protrusion part 16 is an axial direction middle part of the connection pin terminal 15, and is formed so as to protrude in a radial direction (see FIG. 8). The plating layer 17 is provided at an area from the axial direction one end side 15*a* of the connection pin terminal 15 to some midpoint between an axial direction one end side edge portion 16*a* and an axial direction other end side edge portion 16*b* of the protrusion part 16. Thus this area is coated with plating agents that have higher wettability or adhesion properties for the solder than that of the connection pin terminal 15.

The circuit board 12 is provided with a plurality of penetration holes (simply, called holes) 12*a* for receiving therein the plurality of connection pin terminals 15. The connection pin terminal 15 is inserted into the hole 12*a* from the axial direction one end side 15*a* to an axial direction middle part of the plating layer 17.

Figure 9:
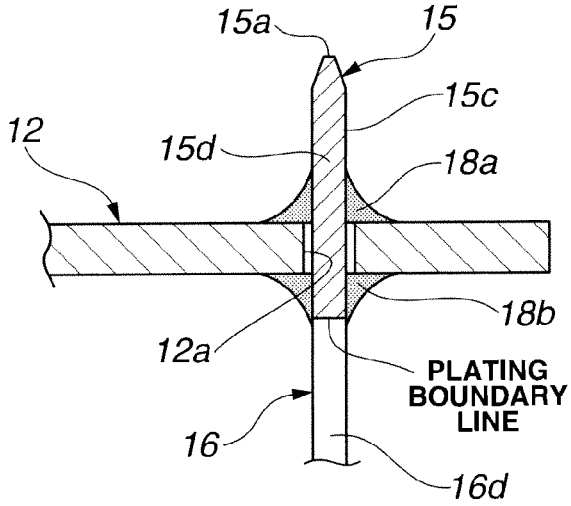
FIG. 9 is a drawing showing a circuit board 12 and the connection pin terminal 15 which are welded (soldered) together by a fifth process of the embodiment 1.

The fillets 18*a* and 18*b* are provided so as to cover the plating layer 17 and the hole 12*a*. The connection pin terminal 15 is then fixed to the circuit board 12 and electrically connected to the circuit board 12. In the following description, as shown in FIGS. 2 and 9, the fillet 18*a* formed on a top surface 12*b* side of the circuit board 12 is called a top fillet 18*a*, the fillet 18*b* formed on a back surface 12*c* side is called a back fillet 18*b*.

[Producing Method of Connector]

Next, a producing method of the connector 14 of the embodiment 1 will be explained for each process. Here, although each process is carried out by machine operation, it could be done by manual operation or by hand.

(First Process)

Figure 3:
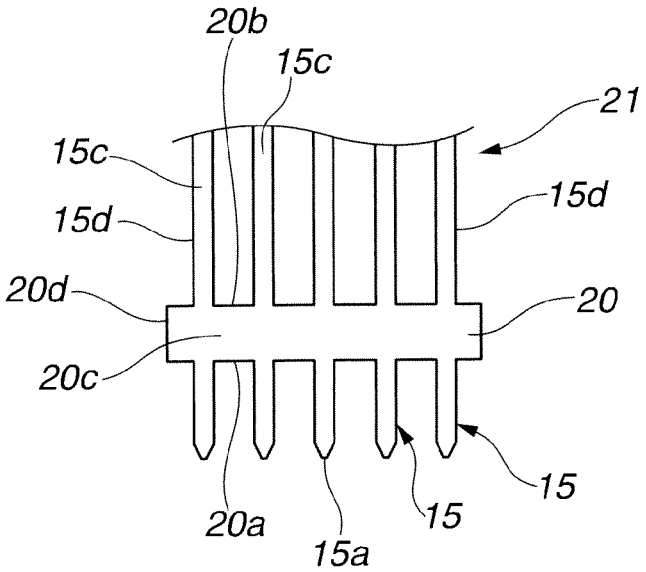
FIG. 3 is a drawing showing a connection pin terminal unit 21 formed by a first process of the embodiment 1.

By press-stamping of a metal plate, a connection pin terminal unit (a contact unit) 21 in which the plurality of connection pin terminals 15 are tied at each axial direction middle part by a tie bar (a tying or connecting part) 20, as shown in FIG. 3, is formed. The connection pin terminal 15 has a width surface 15*c* and a thickness surface 15*d* that is perpendicular to the width surface 15*c*. The width surface 15*c* is a surface that continues through the tie bar 20 or that continuously unites with the other width surfaces 15*c* through the tie bar 20. A cross section normal to the axial direction, of each connection pin terminal 15 is formed so that a width (a thickness) of the thickness surface 15*d* is smaller than a width of the width surface 15*c*.

The tie bar 20 is formed in a direction perpendicular to the axial direction of the connection pin terminal 15. A cross section normal to the axial direction, of the tie bar 20 is a substantially rectangular shape. A width surface 20*c* of the tie bar 20 is flush with the width surfaces 15*c* of the plurality of connection pin terminals 15. Further, the tie bar 20 is formed so that a length from an axial direction one end side edge portion 20*a* to an axial direction other end side edge portion 20*b*, i.e. an axial direction length (here, a width direction length of the width surface 20*c*) of the tie bar 20, is larger than a width (a thickness) of a thickness surface 20*d*. A line of the axial direction one end side edge portion 20*a* is substantially linear.

(Securing Process)

Figure 4:
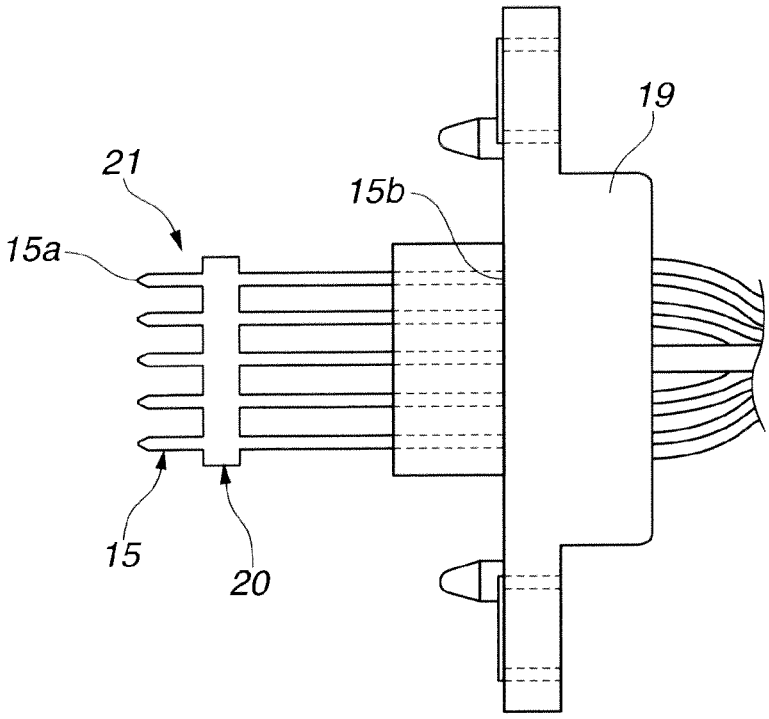
FIG. 4 is a drawing showing the connection pin terminal unit 21 that is joined with a resin mold 19 by a molding process of the embodiment 1.

As shown in FIG. 4, by molding, the plurality of axial direction other end sides 15*b* of the connection pin terminal unit 21 are molded in resin material that is non-conductive material, then the resin mold 19 is formed. This securing (or molding or joining) process is carried out after an after-mentioned second process before a third process. The securing process could be done between the first process and the third process.

(Second Process)

Figure 5:
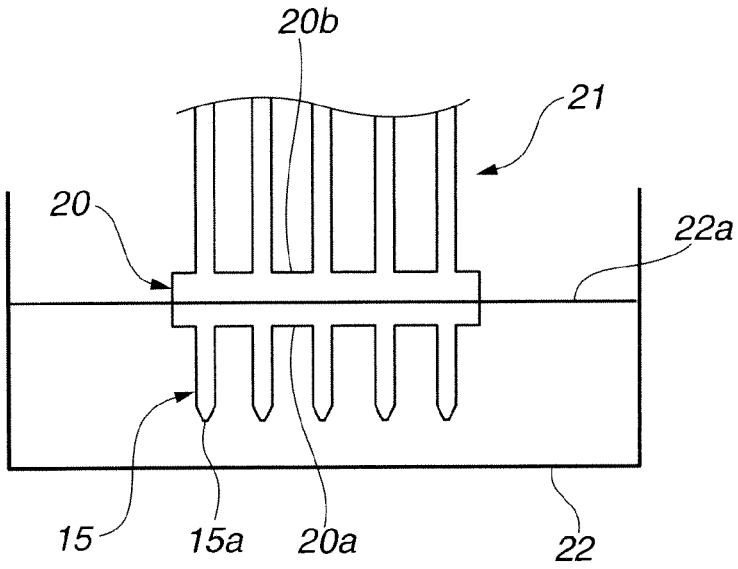
FIG. 5 is a drawing showing a second process of the embodiment 1.

As shown in FIG. 5, the connection pin terminal unit 21 is soaked in a plating bath 22, and the plating layer 17 is formed on a part of the connection pin terminal unit 21. In the plating bath 22, plating agents 22*a* that have higher wettability or adhesion properties than that of the connection pin terminal unit 21 is stored. The connection pin terminal unit 21 is soaked in the plating agents 22*a* of the plating bath 22 from the axial direction one end side 15*a* up to a predetermined position of an axial direction middle part (a part between the axial direction one end side edge portion 20*a* to the axial direction other end side edge portion 20*b*) of the tie bar 20.

(Bending Process)

Figure 6:
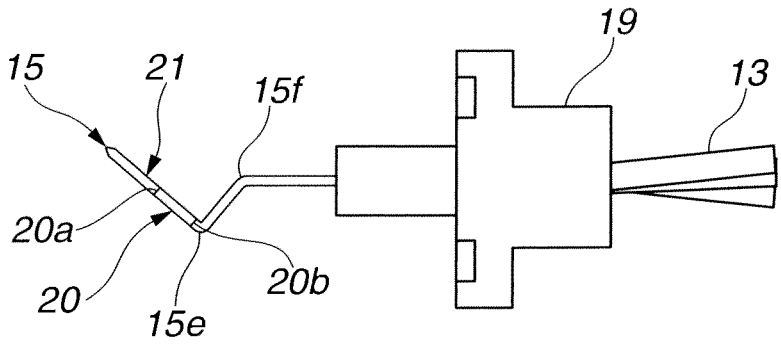
FIG. 6 is a drawing showing a connection pin terminal 15 where bending portions 15*e* and 15*f* are formed by a bending process of the embodiment 1.

As shown in FIG. 6, two bending portions 15*e* and 15*f* are formed for each of the plurality of connection pin terminals 15 of the connection pin terminal unit 21. More specifically, bending directions of the bending portions 15*e* and 15*f* are opposite to each other so that when fixing the resin mold 19 to the housing 8, the plurality of axial direction one end sides 15*a* of the connection pin terminal unit 21 are inserted into the respective holes 12*a*. The bending portion 15*f* is provided at a certain position that is closer to the axial direction other end side 15*b* of the connection pin terminal 15 than a position of the bending portion 15*e*.

(Third Process)

Figure 7:
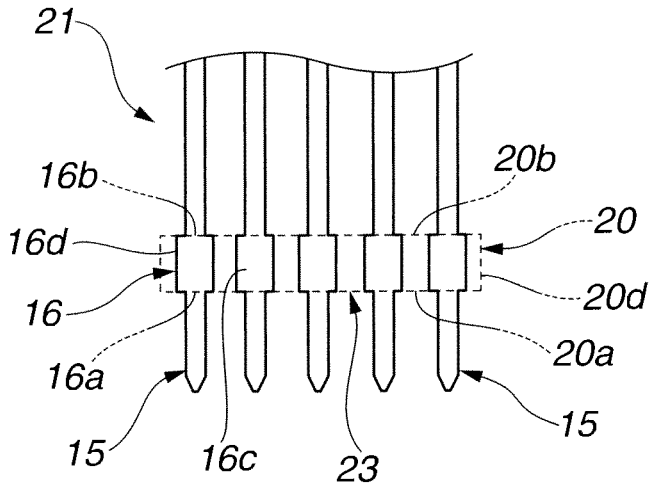
FIG. 7 is a drawing showing a third process of the embodiment 1.

As shown in FIG. 7, by cutting portions between the adjoining connection pin terminals 15 of the tie bar 20, each connection pin terminal 15 is isolated from the adjoining connection pin terminals 15.

FIG. 8 is a perspective view of the connection pin terminal 15 after the cutting. In this process, the tie bar 20 is cut so that a part of the tie bar 20 remains at each connection pin terminal 15, i.e. so that the protrusion part 16 is formed at the axial direction middle part of each connection pin terminal 15 after the isolation. At this time, the cutting is done so that shape of the tie bar 20 remaining at the each connection pin terminal 15, i.e. shapes of the protrusion parts 16, are substantially uniform among the connection pin terminals 15. In addition, regarding a removal part 23 which is a part between a pair of adjoining connection pin terminals 15 and is removed by the cutting, its axial direction width is larger than its thickness direction width.

Here, upon the cutting in this third process, the cutting is done in a direction of a thickness surface 16*d* of the protrusion part 16 with a cutting tool touching the both width surfaces 20*c* of the tie bar 20 so that a width of the thickness surface 16*d* after the cutting is smaller than the width of the thickness surface 20*d* of the tie bar 20.

As can be seen in FIG. 8, positions of boundary lines between the plating layer 17 and a non-plating layer at the connection pin terminal 15 after the third process are different. That is, on the width surface 15*c*, the boundary line is a predetermined position of an axial direction middle part of the protrusion part 16. On the other hand, on the thickness surface 15*d*, the boundary line is positioned at the axial direction one end side edge portion 16*a* of the protrusion part 16.

(Fourth Process)

A part where the plating layer 17 is coated, of each connection pin terminal 15 is inserted into the hole 12*a*.

(Fifth Process)

The plurality of connection pin terminals 15 are soldered to the circuit board 12. As shown in FIG. 9, the connection between the connection pin terminal 15 and the circuit board 12 is achieved by performing point-soldering from the top surface 12*b* side of the circuit board 12. The top fillet 18*a* is formed on the top surface 12*b* side, and the back fillet 18*b* is formed on the back surface 12*c* side. Since a top end side (the axial direction one end side 15*a*) of the connection pin terminal 15 is plated with the plating layer 17, this portion has higher wettability or adhesion properties for the solder, while wettability of a non-plating portion is low. Because of this, the back fillet 18*b* is formed with the boundary line being a start point of the plating.

Next, the agency of the embodiment 1 will be explained.

[Achievement of Uniform Fillet Shape]

In a related art torque sensor, a terminal of a coil assembly that detects torque is directly electrically connected to a circuit board, and an external electrical connection from the circuit board is made by the soldering of connection pin terminals and the circuit board. Here, in order to increase the wettability for the solder, a plating process in which a top end of the connection pin terminal is plated with material (plating agents) having high wettability is performed.

In a related art manner, after forming a connection pin terminal unit, a soaking process in which the top ends of the connection pin terminals are soaked in a plating bath is performed. However, due to capillarity that occurs in a gap between the connection pin terminals, there occur variations in position or shape of a boundary line of a plating layer that is formed between or across the connection pin terminals. For this reason, when connecting each connection pin terminal and the circuit board, shapes of back fillets varies among the plurality of connection pin terminals also among products. If the shape of the back fillet deviates from a desired shape, there is a possibility that poor contact (contact failure of current) or decrease in strength of connecting or fixing will occur.

In contrast, in the producing method of the connector 14 of the embodiment 1, in the first process, the connection pin terminal unit 21 in which the plurality of connection pin terminals 15 are tied at each axial direction middle part by the tie bar 20 is formed. In the second process, the connection pin terminal unit 21 is soaked in the plating bath 22, and the plating layer 17 is formed up to the axial direction middle part of the tie bar 20. Therefore, the boundary line formed at each connection pin terminal 15 in the second process is provided or positioned at the axial direction middle part of the tie bar 20. As a consequence, the influence of the capillarity can be eliminated, and the variations in the boundary line of the plating layer 17 among the plurality of connection pin terminals 15 can be reduced. Hence, the fillet shapes can be uniformly formed among the plurality of connection pin terminals 15 also among products. In particular, in a case where the connection pin terminals 15 are soldered to the circuit board 12 with nonleaded solder (lead-free solder), an effect of uniformly forming the fillet shape is brought to the fore.

Furthermore, in the embodiment 1, in the third process, the tie bar 20 is cut so that a part of the tie bar 20 remains, as the protrusion part 16, at the thickness surface 15*d* of each connection pin terminal 15. As shown in FIG. 8, on the thickness surface 16*d* of the protrusion part 16 which is a cutting surface of the tie bar 20, the plating layer 17 is not formed. On the other hand, the plating layer 17 is formed up to the boundary line on a width surface 16*c* of the protrusion part 16. By leaving or saving (or maintaining) a part where the plating layer 17 is formed (i.e. the width surface 16*c* protruding or extending in the radial direction as compared with the width surface 15*c* of the connection pin terminal 15), a relative rate of an area where the plating layer 17 is formed, in a circumferential direction of the connection pin terminal 15, can be increased. Thus, the uniform fillet shape of the solder can be further obtained.

Here, if the tie bar 20 is cut at a dividing line between the connection pin terminal 15 and the tie bar 20 so that a part of the tie bar 20 does not remain, a sophisticated cutting or control accuracy is required. In addition, there is a risk that the connection pin terminal 15 will be damaged. Thus by cutting the tie bar 20 so that a part of the tie bar 20 remains at the connection pin terminal 15, no sophisticated cutting accuracy is required, and the damage to the connection pin terminal 15 can be suppressed.

Further, shapes of the protrusion parts 16 formed by cutting the tie bar 20 are substantially uniform among the plurality of connection pin terminals 15. Although heat capacity of the connection pin terminal 15 increases by an amount of heat capacity of the protrusion parts 16, since the shapes of the protrusion parts 16 are uniform, the heat capacity are also uniform among the connection pin terminals 15, namely that a soldering condition for each connection pin terminal 15 becomes substantially constant (soldering condition also becomes uniform). Consequently, the uniform fillet shape of the solder can be further obtained.

In the embodiment 1, in the bending process, the bending portion 15*e* formed at the connection pin terminal 15 is provided at the axial direction other end side edge portion 20*b* of the tie bar 20. The axial direction other end side edge portion 20*b* of the tie bar 20 is a portion where a cross-sectional shape of the connection pin terminal 15 changes, thereby facilitating the bending. Therefore, by providing the bending portion 15*e* at this easy-to-bend portion, positioning accuracy of the forming of the bending portion 15*e* can be improved. Further, by performing the bending process with the plurality of connection pin terminals 15 tied by the tie bar 20, bending accuracy of the connection pin terminal 15 can be improved due to rigidity of the tie bar 20.

In the embodiment 1, with respect to the axial direction cross section of the connection pin terminal 15, it is formed so that the width of the width surface 15*c* is larger than the width of the thickness surface 15*d*. Likewise, the width of the width surface 16*c* of the protrusion part 16 is larger than the width of the thickness surface 16*d*. Because the thickness surface 16*d* is the cutting surface, the plating layer 17 is not formed on the thickness surface 16*d*. By forming these thickness surface 15*d* and thickness surface 16*d* to be shorter than the width surface 15*c* and the width surface 16*c* respectively, an area where the plating layer 17 is not formed, in a circumferential direction of the connection pin terminal 15, can be relatively small, and the uniform fillet shape of the solder can be further achieved.

Furthermore, the width of the thickness surface 20*d* of the tie bar 20 is uniformly formed among the connection pin terminals 15. Thus, the boundary line of the plating layer 17, formed when soaking the connection pin terminal unit 21 in the plating bath 22 in the second process, is uniformly formed among the connection pin terminals 15. Moreover, since the width of the thickness surface 20*d* is set to be the almost same as the width of the thickness surface 15*d* of the connection pin terminal 15, by the press-stamping of the plate having a uniform thickness in the first process, the connection pin terminal unit 21 can be easily formed at low cost.

In the embodiment 1, in the third process, the width of the thickness surface 16*d* of the protrusion part 16 after the cutting of the tie bar 20 is smaller than the width of the thickness surface 20*d* of the tie bar 20. On the cutting surface, i.e. on the thickness surface 16*d* of the protrusion part 16, the plating layer 17 is not formed. Since this cutting surface is shorter than the width of the thickness surface 20*d* of the tie bar 20, influence of non-plating layer (non-plating portion) can be relatively small.

In the embodiment 1, in the third process, with regard to the removal part 23 that is cut off from the connection pin terminal 15 when cutting the tie bar 20, its axial direction width is larger than its thickness direction width. That is, by setting the axial direction width of the tie bar 20 to be relatively long, variations in the boundary line of the plating layer 17 can be absorbed.

In the embodiment 1, between the first process and the third process, the securing process in which the axial direction other end sides 15*b* of the connection pin terminal unit 21 are molded in the resin mold 19 is performed. That is, before the third process in which each connection pin terminal 15 is isolated or separated from the connection pin terminal unit 21, the axial direction other end sides 15*b* of the plurality of connection pin terminals 15 are molded or tied by the resin mold 19. This can effectively suppress relative position change or shift of each connection pin terminal 15 in each of the processes after the securing. Accuracy of securing-positioning of the plurality of connection pin terminals 15 can be therefore improved.

In the embodiment 1, the following effects can be obtained.

(1) The method for producing the connector 14 has: the first process that forms the connection pin terminal unit 21, the connection pin terminal unit 21 having the plurality of connection pin terminals 15 made of conductive material and the tie bar 20, the plurality of connection pin terminals 15 being tied at each axial direction middle part of the connection pin terminals 15 by the tie bar 20 with the connection pin terminals 15 arranged substantially parallel to each other, and the width surface 15*c* of the connection pin terminal 15 which continuously unites with the other surfaces of the connection pin terminals 15 through the tie bar 20 and the width surface 20*c* of the tie bar 20 being substantially flat; the second process that forms the plating layer 17 on a part of the connection pin terminal unit 21 by soaking the connection pin terminal unit 21 in the plating bath 22 storing the plating agents 22*a* that have higher wettability than that of the connection pin terminal unit 21 from the axial direction one end side 15*a* of the connection pin terminal unit 21 up to the axial direction middle part of the tie bar 20; the third process that isolates the plurality of connection pin terminals 15 by cutting the tie bar 20; the fourth process that inserts a part where the plating layer 17 is formed, of the each connection pin terminal 15 into the hole 12*a* of the circuit board 12; and the fifth process that solders the connection pin terminals 15 to the circuit board 12. With this, since the width surface 20*c* of the tie bar 20 is substantially flat, the boundary between the plating layer 17 and the non-plating layer formed at the tie bar 20 in the soaking is uniform among the connection pin terminals 15. Since the variations in the boundary line of the plating layer 17 among the plurality of connection pin terminals 15 can be reduced, the fillet shapes can be uniformly formed among the plurality of connection pin terminals 15 also among products. Also poor connection between the connection pin terminals 15 and the circuit board 12 by the soldering can be suppressed.

(2) In the third process, the tie bar 20 is cut so that at least a part of the tie bar 20 remains at the each connection pin terminal 15. Although the plating layer 17 is not formed on the cutting surface, the part of the tie bar 20 where the plating layer 17 remains are present or left, the relative rate of the area where the plating layer 17 is formed, in the circumferential direction of the connection pin terminal 15, can be increased, the uniform fillet shape of the solder can be therefore further obtained.

(3) In the third process, the cutting surface 16*d* of the tie bar 20 is formed so that the thickness of the thickness surface of the cutting surface 16*d* after the cutting is smaller than the thickness of the thickness surface 20*d* of the tie bar 20 before the cutting. Although the plating layer 17 is not formed on the thickness surface 16*d* of the protrusion part 16, since this cutting surface 16*d* is shorter than the width of the thickness surface 20*d* of the tie bar 20, influence of non-plating layer (non-plating portion) can be relatively small, and the uniform fillet shape of the solder can be further obtained.

[Embodiment 2]

In a producing method of the connector 14 of an embodiment 2, a masking process is performed between the first process and the second process. This point is different from the embodiment 1.

(Masking Process)

Figure 10:
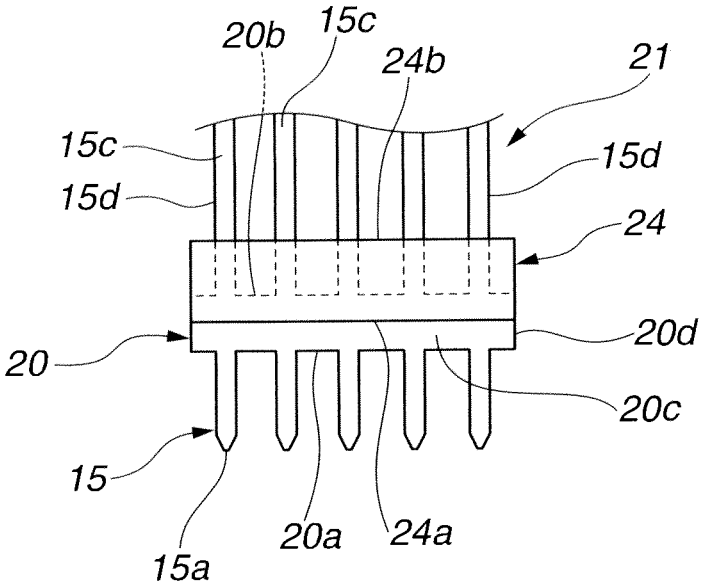
FIG. 10 is a drawing showing the connection pin terminal unit 21 after a masking process of an embodiment 2.

As shown in FIG. 10, both width surfaces 20*c* of the tie bar 20 are masked with a masking tape 24. More specifically, a position (24*a*), which is positioned on a side of the axial direction one end side 15*a* of the connection pin terminal unit 21 with respect to the axial direction middle part of the tie bar 20, is set to a boundary. Then the masking process is performed so that the axial direction one end side 15*a* side with respect to the boundary is exposed and the axial direction other end side 15*b* side is masked. That is, an axial direction one end side edge portion 24*a* of the masking tape 24 is positioned between the axial direction one end side edge portion 20*a* and the axial direction other end side edge portion 20*b* in the axial direction of the tie bar 20. An axial direction other end side edge portion 24*b* of the masking tape 24 is positioned on a side of the axial direction other end side 15*b* of the connection pin terminal 15 with respect to the axial direction other end side edge portion 20*b* in the axial direction of the tie bar 20. The masking process is performed with the masking tape 24 set in a direction perpendicular to the connection pin terminal 15 and set straight.

(Second Process)

Figure 11:
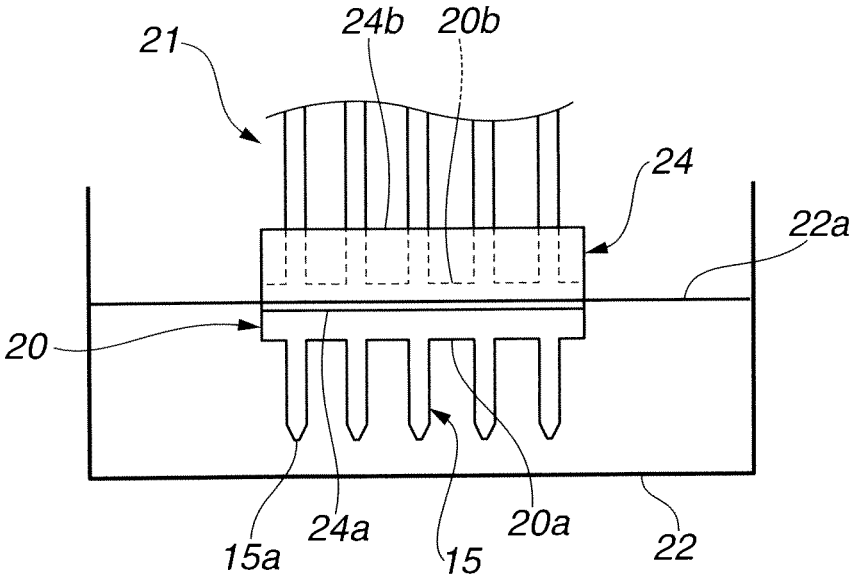
FIG. 11 is a drawing showing a second process of the embodiment 2.

In the embodiment 2, as shown in FIG. 11, the connection pin terminal unit 21 is soaked in the plating agents 22*a* of the plating bath 22 up to a position in excess of the boundary (a position of the axial direction one end side edge portion 24*a*) of the masking tape 24. Before performing the third process, the masking tape 24 is removed from the connection pin terminals 15.

Next, the agency of the embodiment 2 will be explained.

In the embodiment 2, because the connection pin terminals 15 are masked, an inside of the masking tape 24 is not soaked in the plating agents 22*a* when forming the plating layer 17 in the second process. Thus the boundary line of the plating layer 17 becomes the boundary of the masking. Hence, the boundary between the plating layer 17 and the non-plating layer at the connection pin terminal 15 can be formed more accurately. In the masking process, the tie bar 20 is present at the axial direction middle part of the connection pin terminal 15, and the boundary of the masking is provided on the width surface 20*c* of the tie bar 20. Thus there is no need to individually mask circumferential surfaces of each connection pin terminal 15, and this can facilitate masking operation.

If the tie bar 20 is not provided, in order to eliminate the influence of the capillarity, masking all around the circumference of each connection pin terminal 15 is required. This causes a large amount of man-hour and leads to increase in production cost.

Further, providing the boundary line of the masking on the tie bar 20 can save time and manpower to mask both thickness surfaces 20*d* of the tie bar 20.

In the embodiment 2, in addition to the effects of the embodiment 1, the following effects can be obtained.

The masking process is added between the first process and the second process. In the masking process, the position 24*a*, which is positioned on the side of the axial direction one end side 15*a* of the connection pin terminal unit 21 with respect to the axial direction middle part of the tie bar 20, is set to the boundary. Then the masking process is performed so that the axial direction one end side 15*a* side with respect to the boundary is exposed and the axial direction other end side 15*b* side is masked. In the second process, the connection pin terminal unit 21 is soaked in the plating bath 22 from the axial direction one end side 15*a* up to the axial direction other end side 15*b* side with respect to the boundary of the masking (up to the position in excess of the boundary of the masking toward the axial direction other end side 15*b*). With this, the boundary between the plating layer 17 and the non-plating layer can be formed more accurately. Additionally, since the tie bar 20 is provided, the masking can be readily carried out.

[Embodiment 3]

In a producing method of the connector 14 of an embodiment 3, in the second process, the connection pin terminal unit 21 is soaked in the plating agents 22*a* of the plating bath 22 up to the axial direction one end side edge portion 20*a* of the tie bar 20. This point differs from the embodiment 1.

(Second Process)

Figure 12:
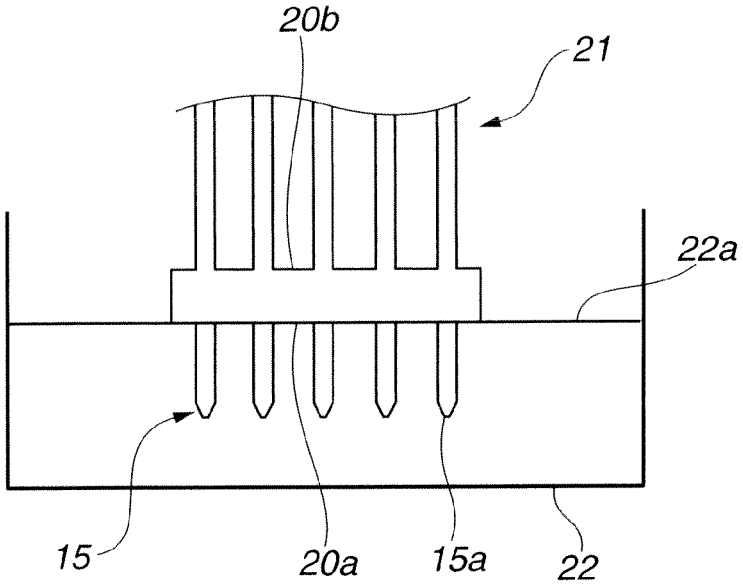
FIG. 12 is a drawing showing a second process of an embodiment 3.

In the embodiment 3, as shown in FIG. 12, when forming the plating layer 17 on a part of the connection pin terminal unit 21, the connection pin terminal unit 21 is soaked in the plating agents 22*a* of the plating bath 22 from the axial direction one end side 15*a* up to the axial direction one end side edge portion 20*a* of the tie bar 20.

Next, the agency of the embodiment 3 will be explained.

Figure 13:
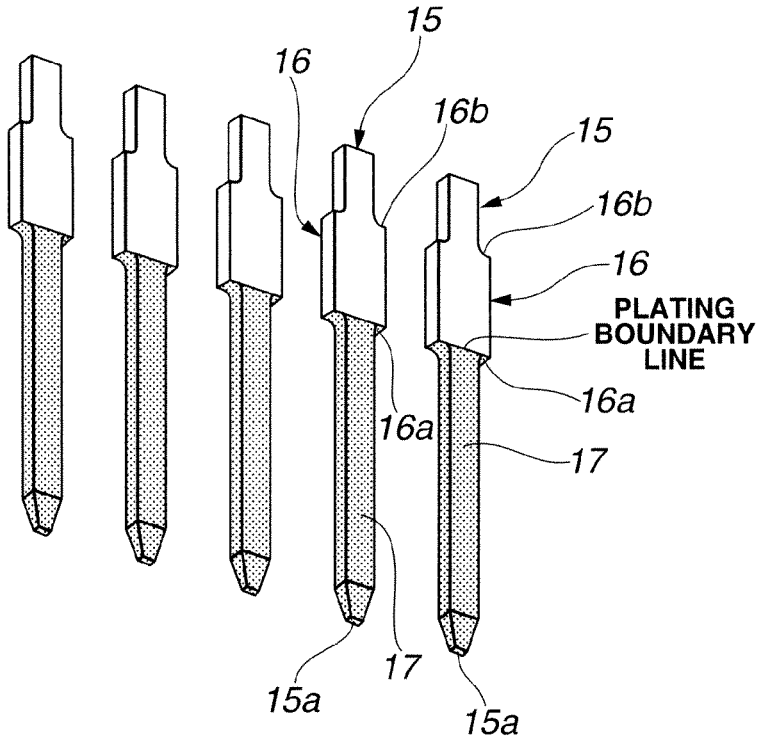
FIG. 13 is a perspective view of the connection pin terminal 15 after a third process of the embodiment 3.

In the embodiment 3, the connection pin terminal unit 21 is soaked in the plating bath 22 up to an area where the axial direction one end side edge portion 20*a* of the tie bar 20 is coated with the plating agents 22*a*. Thus, as shown in FIG. 13, the boundary line of the plating layer 17 is formed all around the circumference of each connection pin terminal 15, and its position is a position of the axial direction one end side edge portion 16*a* (≈ the axial direction one end side edge portion 20*a* of the tie bar 20) of the protrusion part 16. That is, the axial direction one end side edge portion 20*a* of the tie bar 20 acts as a breakwater of the plating agents 22*a*. The boundary lines of the plating layer 17 can be uniform among the connection pin terminals 15.

In the connector 14 of the embodiment 3, the protrusion part 16 protruding outwards in the radial direction is formed at the axial direction middle part of the connection pin terminal 15, and the plating layer 17 is formed up to the axial direction one end side edge portion 16*a* of the protrusion part 16. Therefore, the start point of the back fillet 18*b* formed at the back surface 12*c* side of the circuit board 12 by soldering the connection pin terminal 15 to the circuit board 12 can be set to the axial direction one end side edge portion 16*a* of the protrusion part 16 on the thickness surface 15*d*. That is, since the axial direction one end side edge portion 16*a* prevents the solder from flowing downwards (to the axial direction other end side 15*b* side of the connection pin terminal 15) as the breakwater, the boundary lines of the plating layer 17 can be uniform among the connection pin terminals 15.

In addition, the plating layer 17 is formed on a surface which is exposed to the axial direction one end side edge portion 16*a*, of outer surfaces of the protrusion part 16. Thus the start point of the back fillet 18*b* can be set closer to the axial direction one end side edge portion 16*a* with stability. Also, since the thickness surface 16*d* of the protrusion part 16 is provided with no plating layer 17, the start point of the back fillet 18*b* can be set closer to the axial direction one end side edge portion 16*a* with greater stability.

In the embodiment 3, in addition to the effects of the embodiment 1, the following effects can be obtained.

(4) The method for producing the connector 14 has: the first process that forms the connection pin terminal unit 21, the connection pin terminal unit 21 having the plurality of connection pin terminals 15 made of conductive material and the tie bar 20, the plurality of connection pin terminals 15 being tied at each axial direction middle part of the connection pin terminals 15 by the tie bar 20 with the connection pin terminals 15 arranged substantially parallel to each other, and the width surface 15*c* of the connection pin terminal 15 which continuously unites with the other surfaces of the connection pin terminals 15 through the tie bar 20 and the width surface 20*c* of the tie bar 20 being substantially flat; the second process that forms the plating layer 17 on a part of the connection pin terminal unit 21 by soaking the connection pin terminal unit 21 in the plating bath 22 storing the plating agents 22*a* that have higher wettability than that of the connection pin terminal unit 21 from the axial direction one end side 15*a* of the connection pin terminal unit 21 up to the portion positioned on the axial direction one end side 15*a* with respect to the axial direction middle part of the tie bar 20 also at least the area where the tie bar 20 is coated with the plating agents 22*a*; the third process that isolates the plurality of connection pin terminals 15 by cutting the tie bar 20; the fourth process that inserts a part where the plating layer 17 is formed, of the each connection pin terminal 15 into the hole 12*a* of the circuit board 12; and the fifth process that solders the connection pin terminals 15 to the circuit board 12. With this, since the axial direction one end side edge portion 20*a* of the tie bar 20 acts as the breakwater of the plating agents 22*a*, the boundary lines of the plating layer 17 can be uniform among the connection pin terminals 15.

(5) The connector 14 structure has: the rod-shaped connection pin terminals 15 made of conductive material, the axial direction one end side 15*a* of which is connected to the circuit board 12 by soldering; the protrusion part 16 which is provided at the axial direction middle part of the connection pin terminal 15 and is formed so as to protrude outwards in a radial direction; the plating layer 17 which is provided from the axial direction one end side 15*a* of the connection pin terminal 15 up to the axial direction one end side edge portion 16*a* of the protrusion part 16 and is coated with plating agents 22*a* having higher wettability than that of the connection pin terminal 15; the circuit board 12 which has the hole 12*a* for inserting therein the connection pin terminal 15 from the axial direction one end side 15*a* of the connection pin terminal 15 up to the axial direction middle part of the plating layer 17; and the top fillet 18*a* and the back fillet 18*b* which are provided so as to cover the plating layer 17 of the connection pin terminal 15 and the hole 12*a* of the circuit board 12 and fixes and electrically connects the connection pin terminal 15 to the circuit board 12. With this, the start point of the back fillet 18*b* formed at the back surface 12*c* side of the circuit board 12 by soldering the connection pin terminal 15 to the circuit board 12 can be set to the axial direction one end side edge portion 16*a* of the protrusion part 16 on the thickness surface 15*d*. That is, since the axial direction one end side edge portion 16*a* prevents the solder from flowing downwards (to the axial direction other end side 15*b* side of the connection pin terminal 15) as the breakwater, the boundary lines of the plating layer 17 can be uniform among the connection pin terminals 15.

[Embodiment 4]

In a producing method of the connector 14 of an embodiment 4, the masking process is performed between the first process and the second process. This point is different from the embodiment 3.

(Masking Process)

Figure 14:
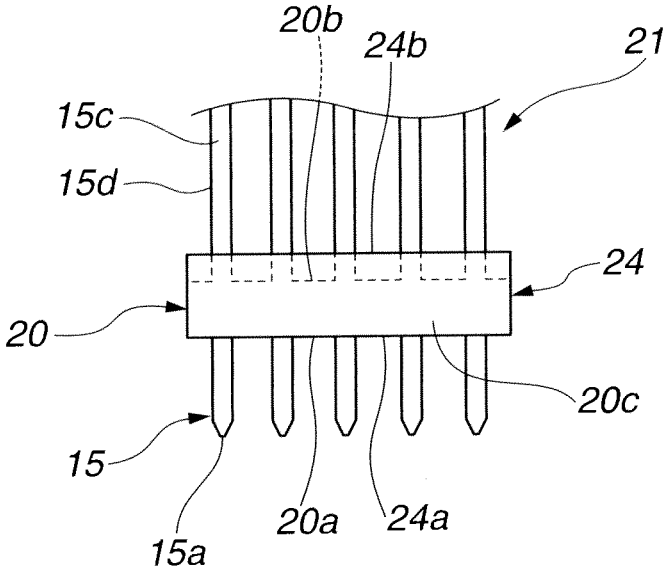
FIG. 14 is a drawing showing the connection pin terminal unit 21 after a masking process of an embodiment 4.

As shown in FIG. 14, both width surfaces 20*c* of the tie bar 20 are masked with the masking tape 24. More specifically, in the connection pin terminal unit 21, the axial direction one end side edge portion 20*a* of the tie bar 20 is set to a boundary. Then the masking process is performed so that the axial direction one end side 15*a* side with respect to the boundary is exposed and the axial direction other end side 15*b* side is masked. That is, a position of the axial direction one end side edge portion 24*a* of the masking tape 24 is the same position as the axial direction one end side edge portion 20*a* of the tie bar 20 in the axial direction of the tie bar 20. The axial direction other end side edge portion 24*b* of the masking tape 24 is positioned on the axial direction other end side 15*b* side of the connection pin terminal 15 with respect to the axial direction other end side edge portion 20*b* in the axial direction of the tie bar 20.

(Second Process)

Figure 15:
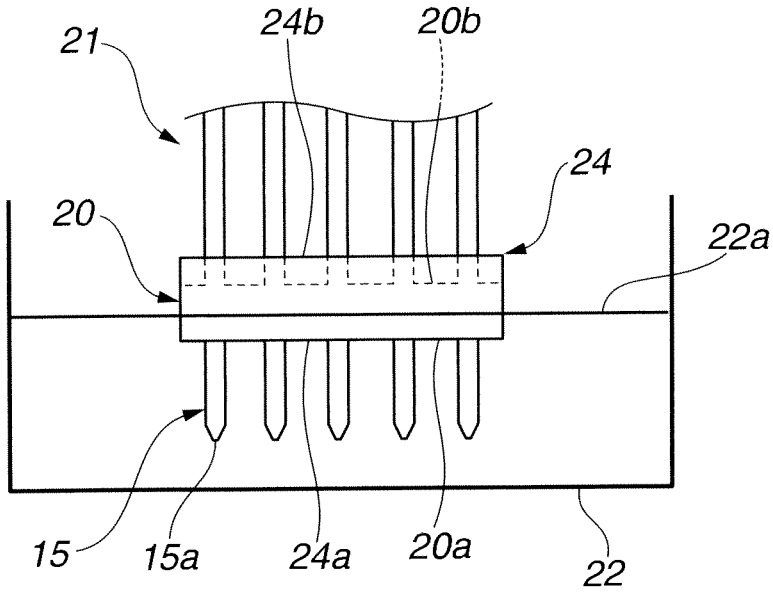
FIG. 15 is a drawing showing a second process of the embodiment 4.

In the embodiment 4, as shown in FIG. 15, the connection pin terminal unit 21 is soaked in the plating agents 22*a* of the plating bath 22 up to a position in excess of the boundary (a position of the axial direction one end side edge portion 24*a*) of the masking tape 24. Before performing the third process, the masking tape 24 is removed from the connection pin terminals 15.

In addition to the effects of the embodiment 1, the embodiment 4 gains both effects as follows. As described in the embodiment 2, the boundary of the plating layer 17 can be formed more accurately by masking. As described in the embodiment 3, since the axial direction one end side edge portion 20*a* of the tie bar 20 acts as the breakwater of the plating agents 22*a*, the boundary lines of the plating layer 17 can be uniform among the connection pin terminals 15.

[Other Embodiments]

Although the invention has been described above by reference to certain embodiments of the invention, the invention is not limited to the embodiments described above.

For instance, although the above embodiments in which the connector and the method of producing the connector of the present invention are applied to and employed for connector used in the torque sensor have been explained, the present invention could be applied to connectors used by soldering a plurality of contacts to the circuit board in a device or apparatus except the torque sensor.

(a) In the present invention, in the third process, the tying part 20 is cut so that at least the part of the tying part (the tie bar) 20 remains at lateral direction both sides of the each contact 15. Although the plating layer 17 is not formed on the cutting surface, the part of the tie bar 20 where the plating layer 17 remains are present or left, the relative rate of the area where the plating layer 17 is formed, in the circumferential direction of the connection pin terminal 15, can be increased, the uniform fillet shape of the solder can be therefore further obtained.

(b) Shapes of the tying part 20 remaining at the contacts 15 by the cutting in the third process are substantially uniform among the plurality of contacts 15. Although the heat capacity of the connection pin terminal 15 increases by an amount of heat capacity of the remaining part of the tying part 20 (i.e. the protrusion parts 16), since the shapes of the protrusion parts 16 are uniform, the heat capacity are also uniform among the connection pin terminals 15, namely that a soldering condition for each connection pin terminal 15 becomes substantially constant (soldering condition also becomes uniform). Consequently, the uniform fillet shape of the solder can be further obtained.

(c) The contact 15 has the bending portion 15*e*, and the bending portion 15*e* is provided closer to the axial direction other end side edge portion 20*b* of the tying part 20. The axial direction other end side edge portion 20*b* of the tie bar 20 is the portion where the cross-sectional shape of the connection pin terminal 15 changes, thereby facilitating the bending. Therefore, by providing the bending portion 15*e* at this easy-to-bend portion, positioning accuracy of the forming of the bending portion 15*e* can be improved.

(d) The cross section normal to the axial direction, of the contact 15 is formed so that the thickness of the thickness surface 15*d* of the contact 15 which is perpendicular to the width surface 15*c* is smaller than the width of the width surface 15*c*. With respect to the axial direction cross section of the connection pin terminal 15, it is formed so that the width of the width surface 15*c* is larger than the width of the thickness surface 15*d*. Likewise, the width of the width surface 16*c* of the protrusion part 16 is larger than the width of the thickness surface 16*d*. Because the thickness surface 16*d* is the cutting surface, the plating layer 17 is not formed on the thickness surface 16*d*. By forming these thickness surface 15*d* and thickness surface 16*d* to be shorter than the width surface 15*c* and the width surface 16*c* respectively, the area where the plating layer 17 is not formed, in the circumferential direction of the connection pin terminal 15, can be relatively small, and the uniform fillet shape of the solder can be further achieved.

(e) The thickness of the thickness surface 20*d* of the tying part 20 which is perpendicular to the width surface 15*c* is substantially uniform among the plurality of contacts 15. The boundary line of the plating layer 17, formed when soaking the connection pin terminal unit 21 in the plating bath 22, is uniformly formed among the connection pin terminals 15.

(f) The thickness of the thickness surface 20*d* of the tying part 20 which is perpendicular to the width surface 15*c* is substantially the same as the thickness of the thickness surface 15*d* of the contact 15. With this, by the press-stamping of the plate having the uniform thickness in the first process, the connection pin terminal unit 21 can be easily formed at low cost.

(g) The masking process is performed between the first process and the second process, wherein the position which is positioned on the side of the axial direction one end side 15*a* of the contact unit 21 with respect to the axial direction middle part of the tying part 20 is set to the boundary, and the masking process is performed so that the axial direction one end side 15*a* with respect to the boundary is exposed and the axial direction other end side 15*b* is masked. And in the second process, the contact unit 21 is soaked in the plating bath 22 from the axial direction one end side 15*a* up to the axial direction other end side 15*b* with respect to the boundary of the masking. By performing the masking process, the boundary between the plating layer 17 and the non-plating layer at the connection pin terminal 15 can be formed more accurately. Further, since the tying part 20 is present, this can facilitate masking operation.

(h) The tying part 20 has removal parts 23 that do not remain between the pair of adjoining contacts 15 by the cutting in the third process, and the axial direction width of the removal part 23 is larger than the thickness direction width of the removal part 23. By setting the axial direction width of the tying part 20 to be relatively long, variations in the boundary line of the plating layer 17 can be absorbed.

(i) The securing process is performed between the first process and the third process and secures axial direction other end sides 15*b* of the contact unit 21 with non-conductive material. Since the axial direction other end sides 15*b* of the plurality of connection pin terminals 15 are molded or tied by an insulator (the resin mold 19) before the third process in which each connection pin terminal 15 is isolated or separated from the contact unit 21, installation of the plurality of connection pin terminals 15, i.e. accuracy of securing-positioning of the plurality of connection pin terminals 15, can be therefore improved.

(j) The non-conductive material is resin material, and the securing process is the process in which the axial direction other end sides 15*b* of the contact unit 21 are secured by resin mold. Since the axial direction other end sides 15*b* of the contact unit 21 are secured or fixed by resin mold, this can effectively suppress relative position change or shift of each connection pin terminal 15 in each of the processes after the securing.

(k) In the second process, the contact unit 21 is soaked in the plating bath 22 substantially up to the axial direction one end side edge portion 20*a* of the tying part 20, and the plating layer 17 is formed substantially up to the axial direction one end side edge portion 20*a* of the tying part 20. Since the axial direction one end side edge portion 20*a* of the tying part 20 is a line of the breakwater of the tying part 20, the boundary line of the plating layer 17 can be uniformly formed.

(l) The masking process is performed between the first process and the second process, wherein the axial direction one end side edge portion 20*a* of the tying part 20 is set to the boundary, and the masking process is performed so that the axial direction one end side 15*a* with respect to the boundary is exposed and the axial direction other end side 15*b* is masked. And in the second process, the contact unit 21 is soaked in the plating bath 22 from the axial direction one end side 15*a* up to the axial direction other end side 15*b* with respect to the boundary of the masking. By performing the masking process, the boundary between the plating layer 17 and the non-plating layer at the connection pin terminal 15 can be formed more accurately. Further, since the tying part 20 is present, this can facilitate masking operation.

(m) The plating layer 17 is formed on the surface which is exposed to the axial direction one end side edge portion 16*a* of the protrusion part 16, among outer surfaces of the protrusion part 16. Since the contact unit 21 is soaked so that the plating agents 22*a* reaches the axial direction one end side edge portion 20*a* of the tie bar 20 and the plating layer 17 is formed up to the surface of the axial direction one end side edge portion 16*a* of the protrusion part 16, the other end side edge portion of the plating layer 17 can be set closer to the axial direction one end side edge portion 20*a* of the tie bar 20 with stability.

(n) The plating layer 17 is formed so that outer circumferential surfaces of the protrusion part 16 which are substantially parallel to the axial direction of the contact unit 21, among the outer surfaces of the protrusion part 16, are not coated with the plating layer 17. Since the contact unit 21 is soaked so that the plating agents 22*a* reaches the axial direction one end side edge portion 20*a* of the tie bar 20 and the outer circumferential surfaces of the protrusion part 16 are not coated with the plating layer 17, the other end side edge portion of the plating layer 17 can be set closer to the axial direction one end side edge portion 20*a* of the tie bar 20 with greater stability.

The entire contents of Japanese Patent Application No. 2009-288920 filed on Dec. 21, 2009 are incorporated herein by reference.

Although the invention has been described above by reference to certain embodiments of the invention, the invention is not limited to the embodiments described above. Modifications and variations of the embodiments described above will occur to those skilled in the art in light of the above teachings. The scope of the invention is defined with reference to the following claims.

What is claimed is:

1. A method for producing a connector comprising:

a first process that forms a contact unit, the contact unit having a plurality of rod-shaped contacts made of conductive material and a tying part, the plurality of contacts being tied at each axial direction middle part of the contacts by the tying part with the contacts arranged substantially parallel to each other, and a width surface of the contact which continuously unites with the other surfaces of the contacts through the tying part and a width surface of the tying part being substantially flat;

a second process that forms a plating layer on a part of the contact unit by soaking the contact unit in a plating bath storing plating agents that have higher wettability than that of the contact unit from an axial direction one end side of the contact unit up to an axial direction middle part of the tying part;

a third process that isolates the plurality of contacts by cutting the tying part;

a fourth process that inserts a part where the plating layer is formed, of the each contact into a hole of an electronic circuit board; and a fifth process that solders the contacts to the electronic circuit board.

2. The method for producing the connector as claimed in claim 1, wherein:

in the third process, the tying part is cut so that at least a part of the tying part remains at the each contact.

3. The method for producing the connector as claimed in claim 2, wherein:

in the third process, the tying part is cut so that at least the part of the tying part remains at lateral direction both sides of the each contact.

4. The method for producing the connector as claimed in claim 3, wherein:

shapes of the tying part remaining at the contacts by the cutting in the third process are substantially uniform among the plurality of contacts.

5. The method for producing the connector as claimed in claim 4, wherein:

the contact has a bending portion, and the bending portion is provided closer to an axial direction other end side edge portion of the tying part.

6. The method for producing the connector as claimed in claim 1, wherein:

a cross section normal to an axial direction, of the contact is formed so that a thickness of a thickness surface of the contact which is perpendicular to the width surface is smaller than a width of the width surface.

7. The method for producing the connector as claimed in claim 6, wherein:

a thickness of a thickness surface of the tying part which is perpendicular to the width surface is substantially uniform among the plurality of contacts.

8. The method for producing the connector as claimed in claim 7, wherein:

the thickness of the thickness surface of the tying part which is perpendicular to the width surface is substantially the same as the thickness of the thickness surface of the contact.

9. The method for producing the connector as claimed in claim 1, wherein:

in the third process, a cutting surface of the tying part is formed so that a thickness of a thickness surface of the cutting surface after the cutting is smaller than the thickness of the thickness surface of the tying part before the cutting.

10. The method for producing the connector as claimed in claim 1, further comprising:

a masking process performed between the first process and the second process, wherein a position which is positioned on a side of an axial direction one end side of the contact unit with respect to an axial direction middle part of the tying part is set to a boundary, and the masking process is performed so that the axial direction one end side with respect to the boundary is exposed and an axial direction other end side is masked, and wherein in the second process, the contact unit is soaked in the plating bath from the axial direction one end side up to the axial direction other end side with respect to the boundary of the masking.

11. The method for producing the connector as claimed in claim 1, wherein:

the tying part has removal parts that do not remain between the pair of adjoining contacts by the cutting in the third process, and an axial direction width of the removal part is larger than a thickness direction width of the removal part.

12. The method for producing the connector as claimed in claim 1, wherein:

an axial direction one end side edge portion of the tying part is substantially linear.

13. The method for producing the connector as claimed in claim 1, further comprising:

a securing process which is performed between the first process and the third process and secures axial direction other end sides of the contact unit with non-conductive material.

14. The method for producing the connector as claimed in claim 13, wherein:

the non-conductive material is resin material, and the securing process is a process in which the axial direction other end sides of the contact unit are secured by resin mold.

15. A method for producing a connector comprising:

a first process that forms a contact unit, the contact unit having a plurality of rod-shaped contacts made of conductive material and a tying part, the plurality of contacts being tied at each axial direction middle part of the contacts by the tying part with the contacts arranged substantially parallel to each other, and a width surface of the contact which continuously unites with the other surfaces of the contacts through the tying part and a width surface of the tying part being substantially flat;

a second process that forms a plating layer on a part of the contact unit by soaking the contact unit in a plating bath storing plating agents that have higher wettability than that of the contact unit from an axial direction one end side of the contact unit up to a portion positioned on the axial direction one end side with respect to an axial direction middle part of the tying part also at least an area where the tying part is coated with the plating agents;

a third process that isolates the plurality of contacts by cutting the tying part;

a fourth process that inserts a part where the plating layer is formed, of the each contact into a hole of an electronic circuit board; and a fifth process that solders the contacts to the electronic circuit board.

16. The method for producing the connector as claimed in claim 15, wherein:

in the second process, the contact unit is soaked in the plating bath substantially up to an axial direction one end side edge portion of the tying part, and the plating layer is formed substantially up to the axial direction one end side edge portion of the tying part.

17. The method for producing the connector as claimed in claim 15, further comprising:

a masking process performed between the first process and the second process, wherein an axial direction one end side edge portion of the tying part is set to a boundary, and the masking process is performed so that the axial direction one end side with respect to the boundary is exposed and an axial direction other end side is masked, and wherein in the second process, the contact unit is soaked in the plating bath from the axial direction one end side up to the axial direction other end side with respect to the boundary of the masking.

* * * * *